US005967248A

United States Patent [19]

Drake et al.

[11] Patent Number: 5,967,248

[45] Date of Patent: Oct. 19, 1999

[54] ROCK BIT HARDMETAL OVERLAY AND PROCESS OF MANUFACTURE

[75] Inventors: Eric F. Drake, Pearland; Harold A. Sreshta, Houston, both of Tex.

[73] Assignee: Camco International Inc., Houston, Tex.

[21] Appl. No.: 08/950,286

[22] Filed: Oct. 14, 1997

[51] Int. Cl.[6] ..... E21B 10/46

[52] U.S. Cl. ..... 175/425; 76/108.2; 175/374

[58] Field of Search ..... 175/374, 428, 175/425, 429, 426, 430, 431, 432; 76/108.2

[56] References Cited

U.S. PATENT DOCUMENTS

| | | | |
|---|---|---|---|
| 3,800,891 | 4/1974 | White et al. | 175/374 |
| 4,365,679 | 12/1982 | van Nederveen et al. | 175/371 |
| 4,368,788 | 1/1983 | Drake | 175/374 |
| 4,372,404 | 2/1983 | Drake | 175/374 |
| 4,396,077 | 8/1983 | Radtke | 175/428 |
| 4,398,952 | 8/1983 | Drake | 419/18 |
| 4,455,278 | 6/1984 | van Nederveen et al. | 419/6 |
| 4,499,795 | 2/1985 | Radtke | 76/108.2 |
| 4,539,175 | 9/1985 | Lichti et al. | 419/49 |
| 4,554,130 | 11/1985 | Ecer | 419/8 |
| 4,562,892 | 1/1986 | Ecer | 175/371 |
| 4,592,252 | 6/1986 | Ecer | 76/108.2 |
| 4,593,776 | 6/1986 | Salesky et al. | 175/375 |
| 4,597,456 | 7/1986 | Ecer | 175/376 |
| 4,630,692 | 12/1986 | Ecer | 175/405.1 |
| 4,726,432 | 2/1988 | Scott et al. | 175/375 |
| 4,836,307 | 6/1989 | Keshavan et al. | 175/374 |
| 4,856,311 | 8/1989 | Conaway | 72/56 |
| 4,884,477 | 12/1989 | Smith et al. | 76/108.2 |
| 4,942,750 | 7/1990 | Conaway | 72/56 |
| 4,944,774 | 7/1990 | Keshavan et al. | 51/309 |
| 4,949,598 | 8/1990 | Griffin | 76/108.2 |
| 5,032,352 | 7/1991 | Meeks et al. | 264/107 |
| 5,110,542 | 5/1992 | Conaway | 419/25 |
| 5,279,374 | 1/1994 | Sievers et al. | 175/374 |
| 5,348,770 | 9/1994 | Sievers et al. | 427/422 |
| 5,492,186 | 2/1996 | Overstreet et al. | 175/374 |
| 5,535,838 | 7/1996 | Keshavan et al. | 175/374 |
| 5,561,834 | 10/1996 | Score | 419/19 |
| 5,653,299 | 8/1997 | Sreshta et al. | 175/374 |
| 5,816,090 | 10/1998 | Hodge et al. | 72/56 |

*Primary Examiner*—William Neuder
*Assistant Examiner*—John Kreck
*Attorney, Agent, or Firm*—Jeffery E. Daly

[57] ABSTRACT

Methods of forming a new wear and abrasion overlay formed with the steel surfaces of components for earth boring bits, and the components formed by the methods are disclosed. The overlay comprises a hard material particulate containing a metal carbide and an alloy steel matrix. The volume fraction of the hard material particulate in the overlay is greater than about 75%, the average particle size of the hard material particulate is between about 40 mesh and about 80 mesh, and the thickness of the overlay is less than about 0.050 inches. The process of manufacture includes the steps of fixing a monolayer of hard material particulate to the surface of a flexible mold, filling the mold with materials and powders, and CIP densifying to form a preform. The preform is then forged to near 100% density in a rapid solid state densification powder metallurgy process. The resulting bit component has an integrally formed overlay with superior physical properties.

27 Claims, 2 Drawing Sheets

Fig. 1
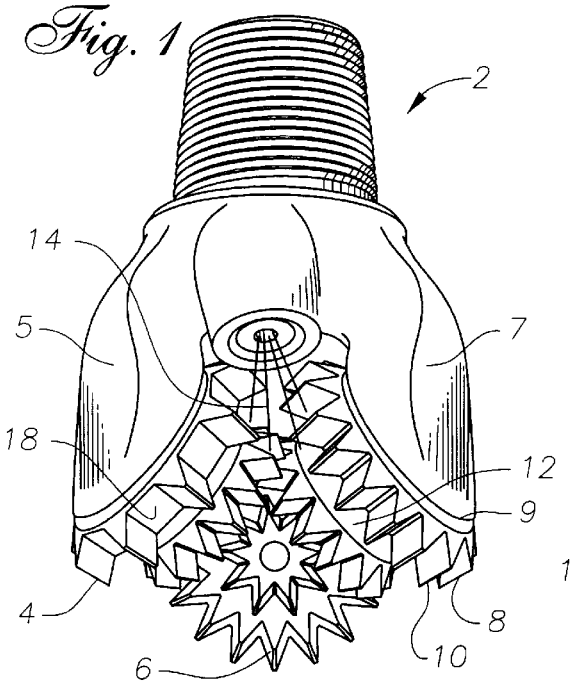
Fig. 2
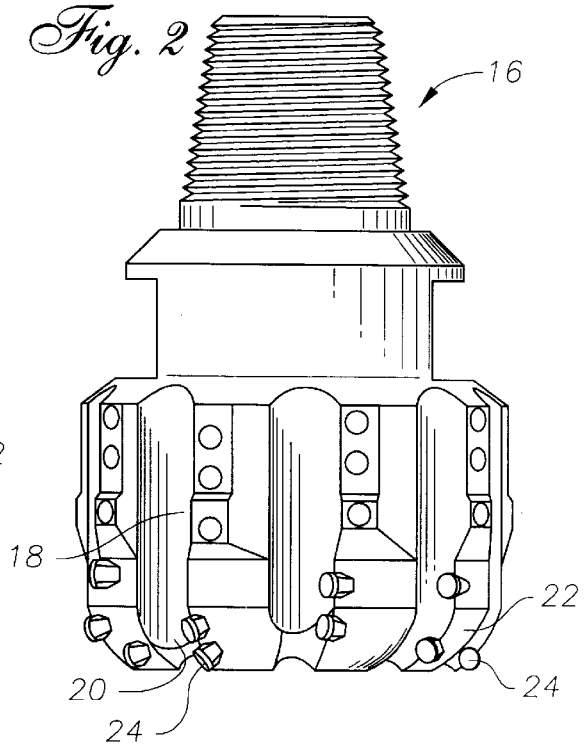
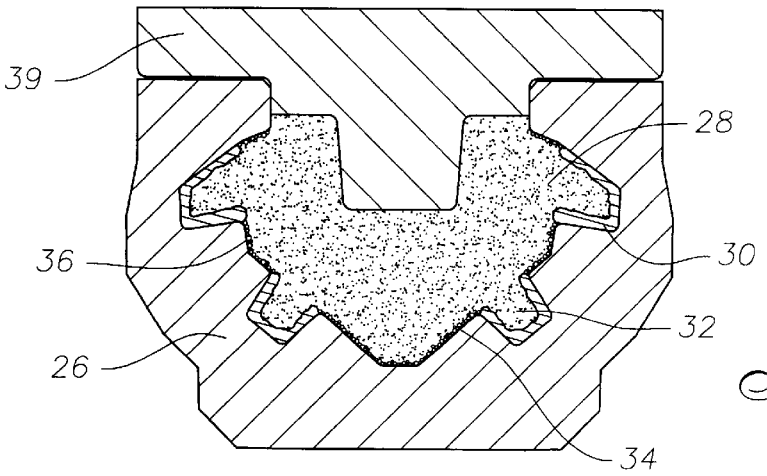
Fig. 3

ROCK BIT HARDMETAL OVERLAY AND PROCESS OF MANUFACTURE

BACKGROUND OF THE INVENTION

1. Field of the Invention

This invention relates to erosion and abrasion resistant overlays on the steel surfaces of earth boring bits.

2. Description of the Related Art

SOLIDIFICATION HARDMETALS

Hardmetal inlays or overlays are employed in rock drilling bits as wear, erosion, and deformation resistant cutting edges and faying surfaces.

The strongest commonly employed hardmetals used in rock drilling bits are made by weld application of sintered tungsten carbide based tube metals or composite rods using iron alloy matrix systems. Heat input during weld deposition of such overlays is critical. Practical control limitations normally result in matrix variation due to alloying effects arising from melt incorporation of sintered carbide hard phase constituents as well as substrate material. Partial melting of cemented carbide constituents results in "blurring" of the hard phase boundaries and the incorporation of cobalt and WC particles into the matrix. Process control is typically challenged to maintain "primary" hardmetal microstructural characteristics such as constituency and volume fraction relationships of hard phases. Secondary characteristics such as matrix microstructure are derivative and cannot be readily regulated.

These overlays typically comprise composite structures of hard particles in a tough metal matrix. The hard particles may be a metal carbide, such as either monocrystalline WC or the cast $WC/W_2C$ eutectic, or may themselves comprise a finer cemented carbide composite material. Often, a combination of hard particle types is incorporated in the materials design, and particle size distribution is controlled to attain desired performance under rock drilling conditions, such as disclosed in U.S. Pat. No. 3,800,891, No. 4,726,432 and No. 4,836,307.

The matrix of these hardmetal overlays may be iron, nickel, cobalt, or copper based, but whether formed by weld deposition, brazing, thermal spraying, or infiltration, the matrix microstructure is necessarily a solidification product. During fabrication, the hard phase(s) remain substantially solid, but the matrix phase(s) grow from a melt during cooling and thus are limited by thermodynamic, kinetic, and heat transport constraints to narrow ranges of morphology, constituency and crystal structure.

Welded composite hard metals encounter several limitations when large areal coverage is needed such as in continuous overlays of bit cutting faces as shown in FIGS. 1 and 2. Foremost of these is the high cost of application. Also, compatibility issues provide physical limits arising from property differentials between substrate materials and overlays, and fabrication logistics become limiting due to thermal stability issues with substrate or cutting elements. These factors have limited welded composite rod hardfacing overlays to crest and flank locations of tooth type roller cone bit cutting structures, and have precluded their use in interference fitted (insert type) roller cone bit cutting structures.

Welded overlays have been incorporated for large areal protection of faces and gage surfaces of drag type polycrystalline diamond composite (PDC) bits. However, necessary compromises in coverage, constituency, and application method have rendered the performance/cost relationship marginal for many PDC products.

Welded hardmetal overlays are commonly used for protection of lug "shirttail" locations of both tooth and insert of roller cone bits, although coverage is necessarily selective, due to cost and the tendency to crack which increases with areal coverage.

Due to the aforementioned limitations, practice in both insert type roller cone and PDC drag bits has gravitated to thermal spray carbide composite coatings for erosion and abrasion protection of large areas. Various thermally sprayed coatings for drill bits are disclosed in U.S. Pat. Nos. 4,396,077; 5,279,374; 5,348,770; and 5,535,838. These coatings are typically too thin, too fine grained, and too poorly bonded to survive long in severe drilling service. In addition, consistency of thermal spray coatings is notoriously variable due to process control sensitivity and geometric limitations during application. Finally, like weld applied hardmetals, thermal spray coatings are similarly limited to solidification microstructures and subject to other process related microstructural constraints.

SOLID STATE HARDMETALS

The development of solid state densification powder metallurgy (SSDPM) processing of composite structures has enabled the fabrication of hardmetal inlays/overlays which potentially include a range of compositions and microstructures not attainable by solidification. In addition, SSDPM processing methodology also provides more precise control of macrostructural and microstructural features than that attainable with fused overlays, as well as lower defect levels. Such methods and resulting full coverage products are described in U.S. Pat. Nos. 4,365,679; 4,368,788; 4,372,404; 4,398,952; 4,455,278; and 4,593,776. However, the relatively slow hot isostatic pressing densification method entails onerous economic implications. It also is restricted to thermodynamically stable materials systems, effectively limiting the potential novelty attainable in composition and microstructure.

The advent of rapid solid state densification powder metallurgy (RSSDPM) processing of composite structures has enabled the fabrication of hardmetal inlays/overlays which include a much broader range of possible compositions and microstructures, as well as more favorable process economics. RSSDPM processing entails forging of powder preforms at suitable pressures and temperatures to achieve full density by plastic deformations in time frames typically of a few minutes or less. Such densification avoids the development of liquid phases and limits diffusional transport. For example, RSSDPM processing can be achieved by filling a flexible mold with various powders and other components to about 55% to 65% of theoretical maximum density, then compressing the filled mold in a cold isostatic press (CIP) at high pressure to create an 80% to 90% dense preform. This preform is then heated to about 2100 degrees F. and forged to near 100% density by direct compression using a particulate elastic pressure transmitting medium. Alternately, the final densification may be achieved by other rapid solid state densification processes, such as the pneumatic isostatic forging process described in U.S. Pat. No. 5,561,834.

Because the components are densified in stages, the size of the preform is significantly smaller than the interior of mold, and the finished part is significantly smaller than its corresponding preform, although each has about the same mass.

RSSDPM processing provides more precise control of microstructural features than that attainable with either fused overlays or slow-densified PM composites. Such fabrication methodologies for rock bits are disclosed in U.S. Pat. Nos. 4,554,130; 4,592,252; and 4,630,692. Shown in these patents and also in U.S. Pat. Nos. 4,562,892 and 4,597,456 are examples of drill bits with wear resistant hardmetal overlays which exploit the flexibility and control afforded by RSSDPM. None of these patents, however, teach or anticipate process-derived physical and microstructural specificity intrinsic to RSSDPM fabrication methods. Nor do they teach economic methods for fabrication or formulation strategies for optimization of full coverage RSSDPM inlays as a function of bit design and application.

Although many unique hardmetal formulations are made possible by RSSDPM, most will not be useful as rock bit hardmetal inlays because they lack the necessary balance of wear resistance, strength, and toughness. In addition, straight forward substitution of RSSDPM processing has been found to produce hardmetals which behave differently in service than their solidification counterparts. Some have exhibited unique failure progressions which disadvantage them for use in drilling service.

For example, a RSSDPM "clone" of a conventional weld applied hardmetal made from 65 wt. percent cemented carbide pellets (30/40 mesh WC-7% Co), and 35 wt % 4620 steel powder, was found to have lower crest wear resistance than expected due to selective hard phase pullout caused by shear localization cracking in the matrix. The presence of sharpened interfaces combined with the formation of ferrite "halos" around carbide pellets propitiates deformation instability under high strain conditions. Even though the primary characteristics normally used to evaluate hardmetal (volume fractions, pellet hardness, matrix hardness, and porosity) were superior to conventional material, the RSSDPM clone exhibited an unexpected weakness.

Other experimentation with RSSDPM hardmetal in drilling service has partially refuted conventional wisdom that maximization of volume fractions of hard phase increases robustness of cutting edges. In hard formations/severe service, tooth crests formulated with high carbide loading made possible with RSSDPM methods were found to be vulnerable to macro scale cracking. However, in locations where high velocity fluid erosion dominates such as water courses and jet-impinged cutter faces, carbide loading and particle size were pushed beyond conventional limits with increasing benefit.

In U.S. Pat. No. 5,653,299, a particular hardmetal matrix microstructure which is very advantageous for rolling cutter drill bits is shown. RSSDPM processing provides a cost effective, controllable way of achieving this matrix microstructure.

Optimization of RSSDPM hard metals entails consideration of both process derived and design derived specificities. The physical demands placed on hard metals differ with location on a bit, and are dependent on bit design characteristics as well as application conditions. In particular, the hardmetal formulations best suited to resist deformation, cracking, and wear modes operative at cutting edges or tooth crests are not optimal to resist abrasion, erosion, and bending conditions operating on cutter or tooth flanks. In turn, hardmetal formulations optimized for bit faces, watercourses, and gage faces will be similarly specific to local erosion, abrasion, wear, and deformation conditions.

POWDER METALLURGY FABRICATION METHODS

Forged, powder metal fabricated rock bits have been developed which incorporate composite powder preforms in the cold isostatic press (CIP) portion of the fabrication cycle in order to produce RSSDPM hardmetal inlays. U.S. Pat. No. 5,032,352, herein incorporated by reference, describes in detail a RSSDPM process particularly applicable to making components for earth boring bits. In particular, the patent describes the method of incorporating previously formed inserts in a mold prior to a CIP densification cycle to form a hardmetal inlay in the finished part. The inserts are usually molded using a powder binder mix in separate tooling.

One preferred method of making these mold inserts employs a metal injection mold process using sintered WC-Co cemented carbide particulate and steel powder bound with an aqueous polymeric fugitive binder such as methylcellulose. The resulting previously formed inserts are inserted into tooth recesses in the elastomeric CIP mold prior to filling with steel powder. After forging, the inserts become fully dense integral hardmetal inlays which can exhibit constituencies covering and exceeding ranges those attainable by various solidification means.

While forming a hard metal layer utilizing preformed insert structures offers performance potential not available via conventional processes, incorporation of preformed inserts requires close conformation to the flexible mold features, in order to provide dimensional control. This entails precision preform fabrication tooling and associated design effort. In addition, practical molding limits on section thickness, aspect ratios, and particle size and volume loading of carbide prevent very thin, very large, and very dense preformed inserts such as may be desirable to achieve the most cost effective and/or functional cutter overlay configurations.

In a completely different fabrication technology (infiltration), U.S. Pat. No. 4,884,477 describes the use of a fugitive adhesive on rigid female mold tooling for incorporation of hard material particulate species to achieve a superficial composite hard metal in PDC drag bit heads. This type of infiltration process typically uses a copper based binder material which melts at a temperature less than about 1000 degrees C. The melted binder fills the spaces between the powders packed within the mold and produces a part which has substantially the same dimensions as the interior of the mold. Also, copper based matrices exhibit lower yield strength and modulus of elasticity than those of the steel alloy matrices available in RSSDPM, making the infiltrated product inferior in service, particularly where significant strains are applied to the product in service. Also, in an infiltration process, the maximum practical attainable volume fraction of hard material particulate is limited to about 70 volume percent due to packing density limitations. Typically the volume percent actually attained is lower than 70%. This limits the wear and erosion resistance of the surface of the infiltrated product.

There is a need for a tough and very wear, abrasion and erosion resistant coating for the steel surfaces of drill bits. Preferably the coating will have a very high volume percent hard material particulate for good wear, abrasion and erosion resistance, and have a steel alloy matrix for strength and toughness. Ideally, the coating would be economical to form, even over large areas of the steel surfaces.

SUMMARY OF THE INVENTION

The present invention is a metallic component of an earth boring bit having a surface formed with an erosion and abrasion resistant overlay which is economical to manufacture and which meets the above described need. The overlay is thin, tough and hard. It is wear and erosion resistant and comprises a hard material particulate containing a metal carbide and an alloy steel matrix. The volume fraction of the hard material particulate in the overlay is greater than about 75%, the average particle size of the hard material particulate is between about 40 mesh and about 80 mesh, and the thickness of the overlay is less than about 0.050 inches. The overlay is formed simultaneously with the surface in a rapid solid state densification powder metallurgy (RSSDPM) process, and is integral with the surface.

Development of the novel RSSDPM hardmetal overlay fabrication method of the present invention has resulted in heretofore unobtainable structures which provide performance benefits and process economies, as well as an optimization protocol necessary to avoid adverse surface effects while maintaining sufficient wear/erosion resistance.

The present invention also provides a method of manufacturing a component for an earth boring bit. This new method of producing forged bits or bit components with RSSDPM hardmetal overlays entails fixing a single layer of hard material particulate mixture upon a flexible CIP mold surface, followed by back filling with a substrate powder mix and CIP processing, followed by forging to full density.

More specifically, a flexible mold is made from a pattern, and a mixture of hard material particulate with a particle size of between about 40 mesh and about 80 mesh is formed. Then, a layer of the hard material particulate is fixed to the surface of the flexible mold, and powder is introduced into the flexible mold. The powder and the hard material particulate is cold compressed into a preform and the preform is then separated from the flexible mold. Finally, the preform is heated in an inert atmosphere and rapidly densified to full density.

It is desirable that the hard particle layer fixed to the mold be limited to about one thickness of hard particles. The hard particle monolayer fixed on flexible mold surfaces is compressed laterally during densification, stacking particles up to several diameters deep in the finished overlay. The combination of flexible female mold tooling, isostatic cold compaction, and non-isostatic forge densification has produced unexpected outcomes due to the unique kinematics of the deformations.

Fixing a particulate layer may be achieved by pre-coating all or a portion of the flexible mold surface with a pressure sensitive adhesive (PSA) and introducing a loose powder mix(es) in one or more steps, followed by decanting the loose residual. Such a powder coating may be used alone or in conjunction with previously formed inserts, in various sequences.

After forging, this method yields a product that has hard metal coverage which can extend continuously or substantially continuously over potentially complex shaped surfaces, without the attendant cost and difficulties of providing close dimensional control of previously formed inserts. In addition, the method permits fabrication of thinner overlays than possible with close cavity molded previously formed inserts. The overlays are integral to the part, as they are formed on the surface of the part as it is densified.

Moreover, the packing and densification mechanics of this method provide unexpected characteristics in the finished overlays, wherein volume fraction of hard phase exceeds that predicted on the basis of theoretical packing density of the hard phase alone. This results from the combination of differential compactions and particle realignments during CIP and forging, accommodated by hard particle plasticity during forging.

Products uniquely obtainable by this method include rolling tooth type bit cutters with integrally formed large area hardmetal coverage having carbide fractions of up to 95 Vol. percent. Similar overlays can be incorporated in insert type roller cutters or PDC drag bit faces, including nozzles and hydraulic courses, extending up to inserted/brazed carbide inserts or cutter elements. RSSDPM hard metal overlay gage surfaces of drag bits or roller cone cutters, as well as other bit components such as lug shirttails and stabilizer pads are also included within the scope of this invention.

This overlay meets the need for a tough and very wear, abrasion and erosion resistant coating for the steel surfaces of drill bits. The overlay has a very high volume percent hard material particulate for good wear, abrasion and erosion resistance, and has a steel alloy matrix for strength and toughness. This overlay is economical to form, even over large areas of the steel surfaces.

BRIEF DESCRIPTION OF THE DRAWINGS

FIG. 1 is a perspective view of a steel tooth rolling cutter drill bit of the present invention FIG. 2 is a perspective view of a drag-type earth boring bit of the present invention.

FIG. 3 is a cross section of a flexible mold containing powders and materials for a component of an earth boring bit of the present invention.

DETAILED DESCRIPTION OF THE PREFERRED EMBODIMENTS

Figure 4:
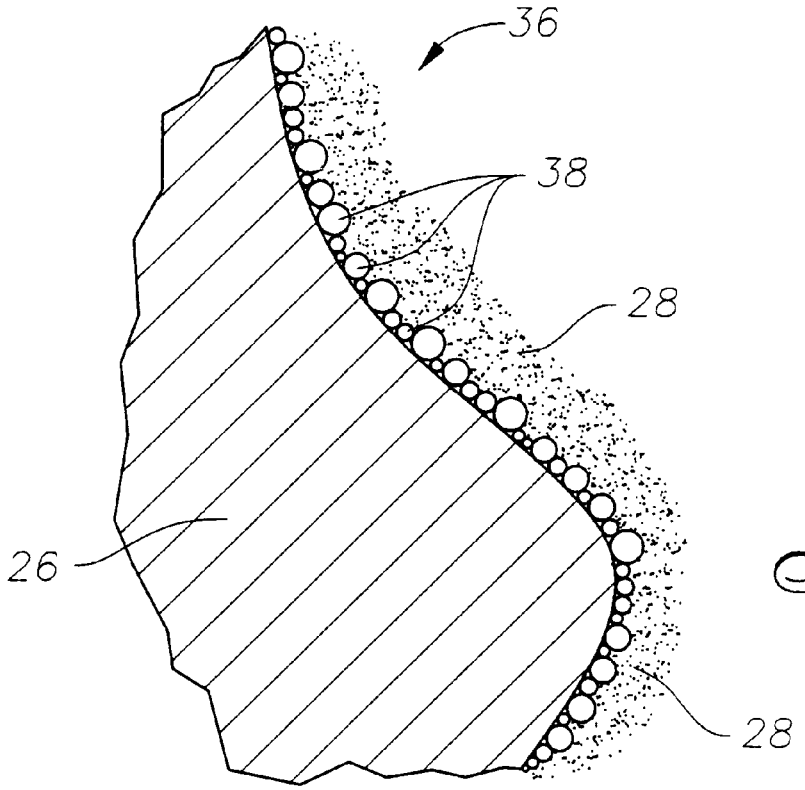
FIG. 4 is an enlarged cross section view of a portion of the hard particle layer as fixed upon the flexible mold of the present invention.

A perspective view of a steel tooth drill bit 2 of the present invention is shown in FIG. 1. A steel tooth drill bit 2 typically has three rolling cutters 4, 6, 8 with a plurality of cutting teeth 10.

The rolling cutters are mounted on lugs 5, 7. The shirttail area 9 of the lug 7 often experiences excessive abrasive and erosive wear during drilling. The exposed surfaces 12 between the teeth 10 are exposed to both abrasive wear due to engaging the earth and to erosive wear from the flushing fluid 14 which impinges their surfaces. Similar wear behavior also occurs on the surfaces of a steel bodied drag bits 16 as shown in FIG. 2. Again, the surfaces 18 near hydraulic courses 20 are prone to erosive wear, and surfaces 22 near the inserted/brazed carbide inserts 24 are subjected to abrasive wear from the earth formations being drilled. These exposed surfaces 9, 12, 18 on bits 2, 16 may be integrally formed with erosion and abrasion resistant overlays in a rapid solid state densification powder metallurgy (RSSDPM) process.

A flexible mold 26 suitable for the RSSDPM process is shown in FIG. 3. FIG. 3 is a cross section view showing such a flexible mold 26 containing powders 28 and materials 30 for a component of an earth boring bit. The interior of the mold 26 shown is in the general form of one of the outer surfaces of rolling cutters 4, 6, 8 except enlarged and elongated. The mold 26 contains shape of teeth 32 and outer surfaces 34 of the cutter. This is a typical arrangement of a flexible mold 26 used in the rapid solid state densification powder metallurgy process, just prior to the cold densification step of the RSSDPM process. A layer of hard particle particulate 36 is shown on the interior surface of the flexible mold 26. Powders 28 are introduced into the flexible mold 26 along with other materials 30. The materials 30 shown in FIG. 3 are previously formed inserts as described in U.S. Pat. No. 5,032,352. However, other types of materials may be placed in the flexible mold 26 in addition to the previously formed inserts.

FIG. 4 is an enlarged cross section view of a portion of the hard particle layer 36 as fixed upon the flexible mold. The layer 36 is comprised of generally spherical particles 38 which may vary in size from about 40 mesh to about 80 mesh. Prior to densification, the layer 36 is generally a single particle in thickness (i.e. a monolayer), although due to the variations in particle size, some overlap of particles is possible. The particles 38 are fixed to the flexible mold 26, preferably with an adhesive (not shown). Other materials (if any) may be introduced into the mold before or after fixing the particles. Once the particles are fixed to the surface of the mold, and the other materials (if any) are introduced into the mold, back fill powders 28 are added. These powders 28 normally contain at least some fine particles which percolate into the interstices between the hard particles 38. A closure 39 (shown in FIG. 3) is added to the mold 26, and the entire assembly is cold densified, preferably in a CIP, to produce a preform. The preform is then heated and further densified in a rapid high pressure forging process to form a finished component.

Figure 5:
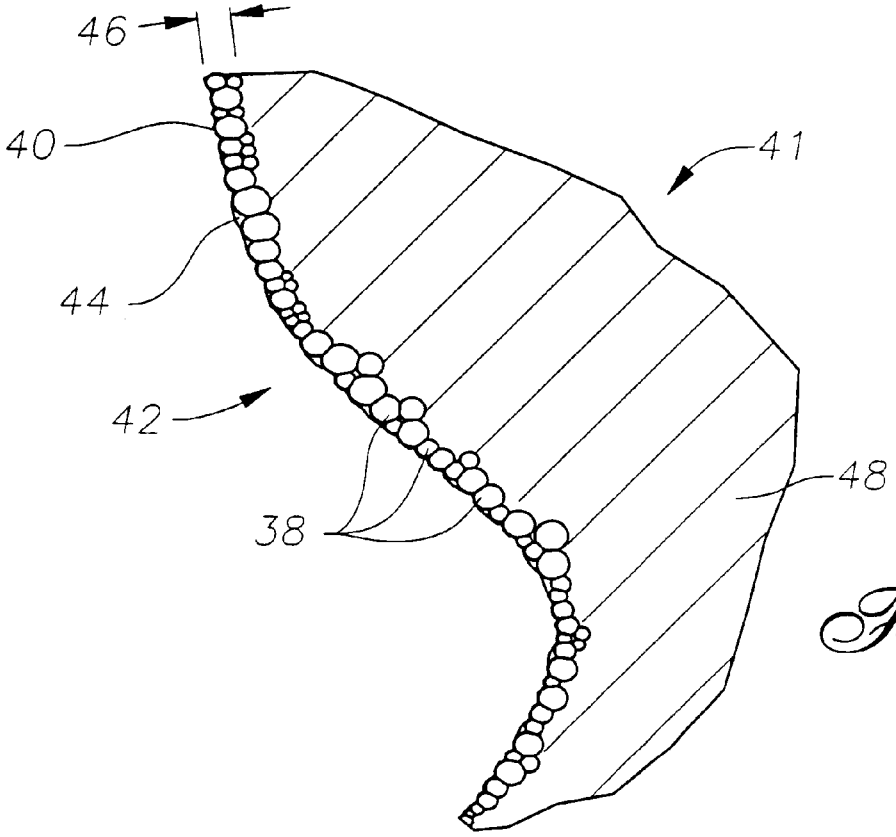
FIG. 5 is an enlarged cross section view of a section of the hard particle layer in a finished article of the present invention.

Shown in FIG. 5 is a cross section view of a portion of the surface 40 of a steel component 41 for an earth boring drill bit with the overlay 42 of the current invention. The body portion 48 of the component 41 is formed from the powders 28 earlier introduced in the flexible mold 26. The surface 40 has an overlay 42 formed simultaneously with the surface which contains hard particles 38 and a continuous iron alloy matrix 44 between the particles 38. The iron alloy matrix 44 is formed from the powders 28 introduced into the flexible mold 26. Although the hard particles 38 are still generally spherical in shape, many are flattened slightly from the forces applied during densification. This deformation tends to further increase the volume density of the overlay 42. Because the hard material particulate 38 also tends to stack during cold and hot densification steps, the particles 38 must be between about 40 mesh and about 80 mesh in diameter. This allows stacking up to about three particles deep (as shown in FIG. 5) without excessive wrinkling, providing an acceptable surface roughness. The overlay 42 on the surface 40 of the present invention greatly improves the wear, erosion, and abrasion resistance as compared to non-overlaid steel surfaces and readily survives the strains which are applied in operations. The thickness 46 of the overlay 42 varies, but the average thickness of the overlay ranges from about one to about three times the average particle size of the hard material particulate 38.

In one preferred embodiment, a rolling tooth type bit cutter 4, 6, 8 is produced with hardmetal coverage over the entire cutting structure surface. The cutter body 4, 6, 8 is formed from pre-alloyed steel powder and employs an integral RSSDPM composite hardmetal overlay covering the entire cutter exterior. The overlay 42 comprises sintered WC-Co pellets in an alloy steel matrix with thickness of about 0.010" to about 0.050". The fraction of sintered carbide phase in the overlay is in the range of 75 Vol. percent to as much as 95 Vol. percent. The binder fraction within the hard phase is the range of 3 wt. percent to 20 wt. percent Co. The particle size of the hard phase is preferably between 40 mesh (0.017 inches or 0.42 mm) and 80 mesh (0.007 inches or 0.18 mm). Multi-modal size distributions may be employed to maximize final carbide density, but significant amounts of particulate 38 larger than 40 mesh will lead to wrinkling instability during densification, causing detrimental surface roughening in the finished cutter. Conversely, average particle sizes below 80 mesh exhibit reduced life in severe drilling service, especially at locations of high velocity fluid impingement.

The preferred methods of making the above described overlay 42 on a component 41 of an earth boring bit 2, 16 include both a method for making the preform which becomes the component and a method for making the component itself.

To make the preform, a pattern or other device is used to make a flexible mold 26 with interior dimensions which are scaled up representations of the finished parts. A mixture of hard material particulate 38 is then made by selecting powders with a particle size of between about 40 mesh and about 80 mesh. A layer 36 of this mixture is then fixed to a portion of the flexible mold 26. Powders 28 and other materials 30 are then introduced into the flexible mold 26. The mold 26 with its contents is then cold isostatically pressed, thereby compacting the powder and the hard material particulate into a preform. The complete preform is then separated from the flexible mold.

To make the finished component, the preform is heated in an inert atmosphere, and rapidly densified to full density.

In the method of the preferred embodiment, a pressure sensitive adhesive is applied to the interior surface of the mold 26 to fix the hard particle particulate 38.

In a related embodiment, the component 41 may have materials 30 with differing formulations to create thicker tooth crest and flank hardmetal inlays, while all remaining cutter shell exterior surfaces have hardmetal overlays 42 created by the pressure sensitive adhesive method.

Although the invention as described has been directed primarily to an overlay formed simultaneously with the cutters of tooth type rolling cutter bits, it is contemplated that many other types of metallic components may be similarly formed within the scope of the present invention. For instance, insert-type roller cutters or PDC drag bit faces may be covered overall, including nozzles and hydraulic courses, up to inserted/brazed carbide inserts or cutter elements. Receiver holes for interference fitted cutter elements may be machined after densification by some combination of electrical discharge machining (EDM), grinding, or boring. The invention is not limited to any particular method of a rapid solid state densification process nor by any particular shape or configuration of the finished component. For instance, components such as lug shirttails, stabilizer pads, and many other components related to earth boring bits are also included within the scope of this invention.

Whereas the present invention has been described in particular relation to the drawings attached hereto, it should be understood that other and further modifications apart from those shown or suggested herein, may be made within the scope and spirit of the present invention.

What is claimed is:

1. A steel component of an earth boring bit having a surface formed with an erosion and abrasion resistant overlay, said overlay comprising a hard material particulate containing a metal carbide and an alloy steel matrix, wherein the volume fraction of said hard material particulate in said overlay is greater than about 75%, the average particle size of said hard material particulate is between about 40 mesh and about 80 mesh, and the thickness of said overlay is less than about 0.050 inches.

2. A steel component of an earth boring bit according to claim 1 wherein the thickness of said overlay is greater than about 0.010 inches and the volume fraction of said hard material particulate in said overlay is less than about 95%.

3. A steel component of an earth boring bit according to claim 2 wherein the thickness of said overlay is greater than about 0.010 inches and the volume fraction of said hard material particulate in said overlay is less than about 95%.

4. A steel component of an earth boring bit having a surface formed with an erosion and abrasion resistant overlay, said overlay comprising a hard material particulate containing a metal carbide and an alloy steel matrix, wherein the volume fraction of said hard material particulate in said overlay is greater than about 75%, the average size of said hard material particulate is between about 40 mesh and about 80 mesh, and the average thickness of said overlay is greater than or equal to one, and less than about three, times the average particle size of said hard material particulate.

5. A steel component of an earth boring bit according to claim 1 wherein said hard material particulate is substantially spherical.

6. A steel component of an earth boring bit according to claim 1 wherein the average thickness of said overlay ranges from about one to about three times the average particle size of said hard material particulate and said hard material particulate is substantially spherical.

7. A steel component of an earth boring bit according to claim 1 wherein said hard material particulate comprises sintered tungsten carbide with a cobalt binder.

8. A steel component of an earth boring bit according to claim 1 wherein said hard material particulate comprises sintered tungsten carbide with a cobalt binder, wherein the fraction of said binder is greater than about 3 weight percent of said hard material particulate.

9. A steel component of an earth boring bit according to claim 1 wherein:

said hard material particulate comprises sintered tungsten carbide with a cobalt binder, wherein the fraction of said binder is greater than about 3 weight percent of said hard material particulate, and said hard material particulate is substantially spherical.

10. A steel component of an earth boring bit according to claim 1 wherein:

said hard material particulate comprises sintered tungsten carbide with a cobalt binder, wherein the fraction of said binder is greater than about 3 weight percent of said hard material particulate, said hard material particulate is substantially spherical, and the average thickness of said overlay ranges from about one to about three times the average particle size of said hard material particulate.

11. A steel component of an earth boring bit having a surface formed with an erosion and abrasion resistant overlay, said overlay comprising a hard material particulate containing a metal carbide and an alloy steel matrix, wherein the volume fraction of said hard material particulate in said overlay is in the range from about 75% and to about 95%, the average particle size of said hard material particulate is between about 40 mesh and about 80 mesh, and the thickness of said overlay is between about 0.010 inches and about 0.050 inches.

12. A steel component of an earth boring bit having a surface formed with an erosion and abrasion resistant overlay, said overlay comprising a hard material particulate containing a metal carbide and an alloy steel matrix, wherein the volume fraction of said hard material particulate in said overlay is in the range from about 75% to about 95%, the average particle size of said hard material particulate is between about 40 mesh and about 80 mesh, and the average thickness of said overlay ranges from about one to about three times the average particle size of said hard material particulate.

13. A steel component of an earth boring bit according to claim 11 wherein said hard material particulate is substantially spherical.

14. A steel component of an earth boring bit according to claim 11 wherein the average thickness of said overlay is greater then or equal to one and less than about three times the average particle size of said hard material particulate and said hard material particulate is substantially spherical.

15. A steel component of an earth boring bit according to claim 11 wherein said hard material particulate comprises sintered tungsten carbide with a cobalt binder.

16. A steel component of an earth boring bit according to claim 11 wherein said hard material particulate comprises sintered tungsten carbide with a cobalt binder, wherein the fraction of said binder is greater than about 3 weight percent of said hard material particulate.

17. A steel component of an earth boring bit according to claim 11 wherein:

said hard material particulate comprises sintered tungsten carbide with a cobalt binder, wherein the fraction of said binder is greater than about 3 weight percent of said hard material particulate, and said hard material particulate is substantially spherical.

18. A steel component of an earth boring bit according to claim 11 wherein:

said hard material particulate comprises sintered tungsten carbide with a cobalt binder, wherein the fraction of said binder is greater than about 3 weight percent of said hard material particulate, said hard material particulate is substantially spherical, and the average thickness of said overlay ranges from about one to about three times the average particle size of said hard material particulate.

19. A metallic component of an earth boring bit having a surface formed with an erosion and abrasion resistant overlay, said overlay comprising a hard material particulate containing a metal carbide and an alloy steel matrix, wherein the volume fraction of said hard material particulate in said overlay is greater than about 75%, the average particle size of said hard material particulate is between about 40 mesh and about 80 mesh, and the thickness of said overlay is less than about 0.050 inches.

20. A metallic component of an earth boring bit according to claim 19 wherein the thickness of said overlay is greater than about 0.010 inches and the volume fraction of said hard material particulate in said overlay is less than about 95%.

21. A metallic component of an earth boring bit having a surface formed with an erosion and abrasion resistant overlay, said overlay comprising a hard material particulate containing a metal carbide and an alloy steel matrix, wherein the volume fraction of said hard material particulate in said overlay is greater than about 75%, the average particle size of said hard material particulate is between about 40 mesh and about 80 mesh, and the average thickness of said overlay is greater than or equal to one, and less than about three, times the average particle size of said hard material particulate.

22. A metallic component of an earth boring bit according to claim 19 wherein said hard material particulate is substantially spherical.

23. A metallic component of an earth boring bit according to claim 19 wherein the average thickness of said overlay ranges from about one to about three times the average particle size of said hard material particulate and said hard material particulate is substantially spherical.

24. A metallic component of an earth boring bit according to claim 19 wherein said hard material particulate comprises sintered tungsten carbide with a cobalt binder.

25. A metallic component of an earth boring bit according to claim 19 wherein said hard material particulate comprises sintered tungsten carbide with a cobalt binder, wherein the fraction of said binder is greater than about 3 weight percent of said hard material particulate.

26. A metallic component of an earth boring bit according to claim 19 wherein:

said hard material particulate comprises sintered tungsten carbide with a cobalt binder, wherein the fraction of said binder is greater than about 3 weight percent of said hard material particulate, and said hard material particulate is substantially spherical.

27. A metallic component of an earth boring bit according to claim 19 wherein:

said hard material particulate comprises sintered tungsten carbide with a cobalt binder, wherein the fraction of said binder is greater than about 3 weight percent of said hard material particulate, said hard material particulate is substantially spherical, and the average thickness of said overlay ranges from about one to about three times the average particle size of said hard material particulate.

* * * * *